US005491503A

United States Patent [19]

Fuwa

[11] Patent Number: 5,491,503

[45] Date of Patent: Feb. 13, 1996

[54] STENCIL-PRODUCING APPARATUS

[75] Inventor: Tetsuji Fuwa, Hashima, Japan

[73] Assignee: Brother Kogyo Kabushiki Kaisha, Aichi, Japan

[21] Appl. No.: 125,789

[22] Filed: Sep. 24, 1993

[30] Foreign Application Priority Data

Sep. 24, 1992 [JP] Japan ..... 4-280888

[51] Int. Cl.[6] ..... B41J 2/32

[52] U.S. Cl. ..... 347/171

[58] Field of Search ..... 101/129, 128.4, 101/121; 347/171

[56] References Cited

U.S. PATENT DOCUMENTS

| | | | |
|---|---|---|---|
| 5,186,102 | 2/1993 | Kanno et al. | 101/128.4 |
| 5,251,567 | 10/1993 | Fuwa | 101/128.4 |
| 5,329,848 | 7/1994 | Yasui et al. | 101/121 |
| 5,384,585 | 1/1995 | Okumura | 346/76 PH |

FOREIGN PATENT DOCUMENTS

| | | |
|---|---|---|
| 0500334 | 8/1992 | European Pat. Off. . |
| 0517541 | 12/1992 | European Pat. Off. . |
| 62-264995 | 11/1987 | Japan . |
| 1-055260 | 3/1989 | Japan . |
| 2-67133 | 3/1990 | Japan . |
| 0144574 | 6/1990 | Japan . |
| 2-252568 | 10/1990 | Japan . |

*Primary Examiner*—Huan H. Tran
*Attorney, Agent, or Firm*—Oliff & Berridge

[57] ABSTRACT

In the stencil-producing apparatus of the present invention, both the stencil production and the thermal printing are possible. In the apparatus, a thermal head performs stencil production by forming dot-shaped perforations in a heat-sensitive stencil medium and prints images by forming dot-shaped images in a heat-sensitive imaging medium by heating a plurality of thermal elements aligned in a main scanning direction. During thermal printing, the pitch of the relative movement between the heat-sensitive medium and the thermal element in the auxiliary direction is set to a minimal. During stencil production, heat drive of the thermal elements is selectively precluded in the main scanning direction. Heat drive of the thermal elements is selectively precluded also in the auxiliary scanning direction. Or otherwise, the pitch of the relative movement between the thermal head and the heat-sensitive stencil medium in the auxiliary scanning direction is increased to a pitch longer than the pitch during printing. This provides spaces between adjacent dots of the resultant stencil. Stencil printing with no blurring and no set off can be achieved with such a stencil. Also, good thermal printing on heat-sensitive imaging medium with no spaces between adjacent dots during printing can be achieved.

17 Claims, 8 Drawing Sheets

STENCIL-PRODUCING APPARATUS

BACKGROUND OF THE INVENTION

1. Field of the Invention

The present invention relates to a stencil-producing apparatus for producing stencils in a heat-sensitive medium using a plurality of thermal elements of, for example, a thermal head, and more particularly to the stencil-producing apparatus also serving as a printing apparatus.

2. Description of the Related Art

A conventional stencil-producing apparatus includes a thermal head containing a plurality of thermal elements. The stencil-producing apparatus forms stencils in a heat-sensitive stencil paper. The heat-sensitive stencil paper is made from a thermoplastic resin film adhered to a porous support member. The stencil-producing apparatus produces stencils by melting small holes, or perforations, in the thermoplastic resin film side of the heat-sensitive stencil paper using the thermal elements. As shown in FIG. 1, a conventional stencil-producing apparatus 100 includes the thermal head 25 containing the thermal elements 26, a platen roller 24 and transport rollers 22 and 23. The transport rollers 22 and 23 transport a sheet of heat-sensitive stencil paper 30 sandwiched therebetween in a direction indicated by arrow A (which will be referred to as an "auxiliary scanning direction," hereinafter) so as to insert it between the platen roller 24 and the thermal head 25. The platen 24 presses the thermoplastic resin film 30*a* of the heat-sensitive stencil paper 30 into direct contact with the thermal elements 26 of the thermal head 25. A stencil pattern is formed by perforations in the thermoplastic resin film 30*a* of the heat-sensitive stencil paper 30 by selectively heating the thermal elements 26.

When the thermal element 26 is energized and begin to heat, the temperature of the thermoplastic resin film 30*a* in direct contact with the thermal element 26 also rises. When the temperature of the thermoplastic resin film 30*a* rises to a predetermined shrivel start temperature ta (temperature where the thermoplastic resin film 30*a* starts to shrivel), a small perforation opens and expands in the thermoplastic resin film 30*a*. On the other hand, when energizing of the thermal elements 26 stops, the thermal elements 26 release heat and the temperature of the thermoplastic resin film 30*a* lowers below another predetermined shrivel stop temperature tb (temperature where shriveling stops) whereupon the perforation in the thermoplastic resin film 30*a* stops expanding and the thermoplastic film resin hardens. Incidentally the shrivel start temperature ta is greater than the shrivel stop temperature tb.

As shown in FIG. 2, when producing a stencil, each thermal element 26 of a size (a) melts a perforation dot having a size (b) in the heat-sensitive stencil paper 30, the size (b) being only slightly larger than the size (a). However, when stencil printing is performed using the perforation dot of the size (b), ink flows through the perforation dot of the size (b) and spreads on the print paper into a size (c) print pattern, the size (c) being much larger than the size (b). Therefore, although the size of the perforation in the heat-sensitive stencil paper 30 is almost the same as that of the thermal element 26 of the thermal head 25, when heat-sensitive stencil paper 30 with perforations of this size are used for perforation-stencil printing, the extent that ink spreads on the paper is rather large.

As the thermal head 25 of the stencil-producing apparatus 100 of FIG. 1, a thermal head employed in a conventional facsimile machine can be utilized. As shown in FIG. 4 (*a*), the thermal head 25 generally includes a plurality of thermal elements 26 arranged in a linear array in a main scanning direction B which extends perpendicularly to the auxiliary scanning direction A. Each of the thermal elements 26 has a rectangular shape having a width W in the main scanning direction B and having a length L in the auxiliary scanning direction A. The length L has a value almost twice the value of the width W. The thermal elements 26 are arranged in the main scanning direction B with a pitch P. The pitch P is slightly larger than the width W of the thermal element 26. A small amount of gap G is therefore formed between adjacent thermal elements 26. A pair of electrodes 27 are connected to both sides of each thermal element 26 in the auxiliary scanning direction A for supplying power to the thermal element 26. The transport rollers 22 and 23 are so designed to feed the heat-sensitive stencil paper 30 in the auxiliary scanning direction A by a line distance almost equal to the pitch P.

Such a thermal head 25 employed in a conventional facsimile machine is, however, not well suited for producing stencils in heat-sensitive stencil paper 30, as follows.

In the case where it is desired to produce a solid pattern stencil in the heat-sensitive stencil paper 30, all of the thermal elements 26 of the thermal head 25 are energized to heat the heat-sensitive stencil paper 30. Since the area (=W×L) of each thermal element 26 is relatively large, each thermal element 26 can apply high printing energy per unit area to the heat-sensitive stencil paper 30. As a result, the surface temperature at inter-dots areas between dots adjacent on the thermoplastic resin film 30*a* in the main scanning direction sometimes rises above the shrivel stop temperature tb. When this happens, the perforation enlarges from the center of each dot into the inter-dot space. Since the gap G between adjacent thermal elements 26 in the main scanning direction B is relatively small, the perforation continues enlarging into the adjacent dot. If many adjacent dots are connected in this way, a continuous perforation is formed in the main scanning direction, as shown in FIG. 4(*b*).

The auxiliary scanning operation by the transport rollers 22 and 23 feeds the heat-sensitive stencil paper 30 by the line distance P. The auxiliary scanning operation therefore arranges the dot perforations in the auxiliary scanning direction with the pitch P. Since the pitch P is smaller than the length L of each thermal element 26 and since the size of each dot perforation is almost the same as the size of the thermal element 26, the dot perforations arranged in the auxiliary scanning direction partly overlap with each other. Many adjacent dots are thus overlapped in this way, resulting in that a continuous perforation is formed also in the auxiliary scanning direction, as also shown in FIG. 4(*b*).

Attempting to produce such a solid stencil pattern in the heat-sensitive stencil paper 30 may therefore form a large continuous perforation with no inter-dot spaces, either in the main scanning direction or the auxiliary scanning direction. In this situation, melted and fluid thermoplastic resin film becomes entwined with the fiber of the support member, filling the pores therein. Ink can not pass through the support member when pores are clogged in this way and such clogged areas show up in the stencil print as white patches in black image portions. That is, there has been a problem in that printed images appear similar to those printed on traditional Japanese paper. Also, more ink is transferred to the print paper through areas with perforations connected as described above than through independent perforations, which increases the likelihood of set off. Also, areas of connected perforations can also be formed as described above when producing stencils of characters or lines because these are formed by dots in continuous horizontal and vertical rows, that same was as solid patterns. A large amount of ink is transferred to the print paper through areas in the film with connected perforations, creating blurred character images and line images because they print thicker than desired.

In order to solve the above-described problems, Japanese Patent Application Kokai No. HEI-2-67133 has proposed a thermal head suited for a stencil-producing apparatuses. This document has proposed to shorten the length L of each thermal element 26. That is, as shown in FIG. 5 (*a*), each thermal element 26 of the thermal head 25 of this document has a new length L' which is smaller than the pitch P. Since the heat-sensitive stencil paper 30 is fed in the auxiliary scanning direction by the line distance P, the dots produced to be arranged in the auxiliary scanning direction A do not overlap with each other. In addition, since the length L' is smaller than the length L, the area (W×L') of the proposed thermal element 26 becomes smaller than the area (W×L) of the thermal element 26 of FIG. 4(*a*). Accordingly, the printing energy per unit area applied from each thermal element 26 to the heat-sensitive stencil paper 30 becomes small, which prevents the perforation from enlarging from the center of each dot into the inter-dot space in the main scanning direction B and further into the adjacent dot.

Thus, the construction proposed by this document provides a space between dot perforations formed in the thermoplastic resin film 30*a* of the heat-sensitive stencil paper 30 both in the auxiliary scanning direction A and in the main scanning direction B. As shown in FIG. 5 (*b*) , when a solid pattern stencil is produced in heat-sensitive stencil paper 30 using this thermal head 25, each perforation dot is separate and unconnected in both the main scanning direction and the auxiliary scanning direction. Stenciling with perforation dot in this condition can form a good solid print.

SUMMARY OF THE INVENTION

The present inventor has noticed that, in the stencil-producing apparatus of FIG. 1, simply inserting a heat-sensitive paper 30 in place of the heat-sensitive stencil paper 30 between the transport rollers 22 and 23 can thermally print images on the heat-sensitive paper. That is, the above-described thermal element 26 of the thermal head 25 can also thermally print on a heat-sensitive paper. The heat-sensitive paper 31 generally includes a support paper coated with a heat-sensitive layer 31*a* where electron donor particles and electron acceptor particles are dispersed. When the thermal element 26 heats the heat-sensitive paper, temperature of the heat-sensitive layer rises, upon which the electron doner particles and the electron acceptor particles start performing coloring reaction. As a result, coloring material is formed in the heat-sensitive layer 31*a*. Thus, an image dot is formed or printed on the heat-sensitive paper.

As shown in FIG. 3, the thermal element 26 of the size (a) can thermally print an image dot of the size (b) on the heat-sensitive paper 31, the size (b) being almost the same as the size (a). Therefore, size of the thermally printed dot of the heat-sensitive paper is almost the same size as the thermal element 26. It is apparent from FIGS. 2 and 3 that the size (b) of the printed dot formed on the paper 31 by the thermal element of the size (a) is almost the same as the size (b) of the perforation dot formed on the stencil paper 30 by the thermal element of the same size (a). Accordingly, the ink image of the size (c) of FIG. 2 obtained through the stencil printing operation with the use of the thermal element of the size (a) becomes much larger than the printed image of the size (b) obtained through the printing operation with the use of the same thermal element.

The present inventor has noticed that the above-described stencil-producing apparatus 100 employed with the thermal head 26 shown in FIG. 4(*a*) is well suited for thermally printing a solid pattern on a heat-sensitive paper, as follows.

When it is desired to print a solid pattern on the heat-sensitive paper, all the thermal elements 26 are energized to heat the heat-sensitive paper. Similarly as in the case of producing the solid stencil pattern, since the heat-sensitive paper is fed in the auxiliary scanning direction by the line distance P smaller than the length L, printed dots are formed to be arranged in the auxiliary scanning direction A in such a manner that they are partly overlapped with one another. In addition, since the area (=W×L) of each thermal element 26 is relatively large, each thermal element can apply high printing energy per unit area to the heat-sensitive layer 31*a*. Temperature of the heat-sensitive layer 31*a* therefore rises, not only at the areas contacted with the thermal elements 26 but also at the areas adjacent the thermal element-contacted areas in the main scanning direction B. Since the gap G between adjacent thermal elements 26 is relatively small, the temperature at inter-dot areas between adjacent dots entirely rises. Accordingly, coloring reaction is performed in the heat-sensitive layer 31*a* not only at the thermal element contacted areas but also at the inter-dot areas. As a result, a colored or printed area is formed to continuously spread over the adjacent dots. In other words, the adjacent dots are connected to provide a large printed area spreading over the adjacent dots.

Thus, many adjacent dots are connected in this way both in the main scanning direction and in the auxiliary scanning direction, resulting in that a continuous printing area is formed. Accordingly a continuous printing area similar to the continuous perforation as shown in FIG. 4 (*b*) is thermally printed on the heat-sensitive paper. This continuous printing area is a good solid pattern with no spaces between adjacent dots.

The present inventor has further noticed that the stencil-producing apparatus 100 employed with the thermal head 25 shown in FIG. 5(*a*) is not suited for thermally printing a solid pattern on a heat-sensitive paper 31. Since the length L' of the thermal element is smaller than the line distance P at which the heat-sensitive paper 31 is fed, the dots produced to be arranged in the auxiliary scanning direction A do not overlap with each other. In addition, since the length L' is smaller than the length L, the area (W×L') of the thermal element 26 of FIG. 5(*a*) becomes smaller than the area (W×L) of the thermal element 26 of FIG. 4(*a*). Accordingly, the printing energy per unit area applied from each thermal element 26 to the heat-sensitive paper 31 becomes small, which prevents the printed area from spreading over the adjacent dots in the main scanning direction. Accordingly, each image dot is separate and unconnected in both the main scanning direction and the auxiliary scanning direction, similarly to the stencil pattern as shown in FIG. 5 (*b*). Accordingly, this stencil-producing apparatus 100 employed with the thermal head 25 of FIG. 5(*a*) can be used exclusively for producing stencils and not for thermally printing on heat-sensitive paper.

Accordingly, an object of the present invention is to provide an apparatus in which both producing a stencil in a heat-sensitive stencil paper and thermally printing images or characters on a heat-sensitive paper are possible in the same apparatus. It is desired that when producing stencils in the heat-sensitive stencil paper, spacing should be provided between dots, and when thermal printing on the heat-sensitive paper, thermal printing should be performed without spaces between the dots. In this way, it is an objective of the present invention to provide a stencil-producing apparatus capable of good stencilling and thermal printing of images or characters.

To attain the above objectives, the present invention provides an apparatus capable of producing a desired stencil from heat-sensitive stencil medium in a stencil-producing mode and capable of thermally printing a desired image on heat-sensitive imaging medium in a printing mode, the apparatus comprising: a plurality of thermal elements aligned in a main scanning direction; thermal element control means for receiving one set of dot data which includes a plurality of dot data representative of one desired line image and for selectively energizing the thermal elements in accordance with the respective dot data, the thermal element control means selectively preventing the thermal elements from being energized irrespective of the dot data in a stencil-producing model and supporting means for supporting a heat-sensitive stencil medium in direct contact with the thermal elements in the stencil-producing mode so as to allow the selectively energized thermal elements to selectively heat the heat-sensitive stencil medium to form therein a row of dot-shaped perforations which extends in the main scanning direction and which may produce the desired one line image through a stencil printing operation and for supporting a heat-sensitive imaging medium in direct contact with the thermal elements in a printing mode so as to allow the selectively energized thermal elements to selectively heat the heat-sensitive imaging medium to form thereon a row of dot-shaped images which extends in the main scanning direction and which corresponds to the one desired line image.

The thermal element control means may preferably include: input means for receiving the one set of dot data including the plurality of dot data for the respective ones of the thermal elements; energizing means for energizing the thermal elements in accordance with the dot data; and first energize preventing means for selectively preventing the thermal elements from being energized by the energizing means irrespective of the dot data in the stencil-producing mode to thereby selectively prevent dot-shaped perforations from being formed in the row of dot-shaped perforations in the heat-sensitive stencil medium.

The first energize preventing means may selectively prevent energization of the thermal elements for every other thermal element, to thereby separate, from one another, the dot-shaped perforations actually formed in the heat-sensitive stencil medium, the separate dot-shaped perforations being capable of producing the desired one line image through a stencil printing operation.

The first energize preventing means may preferably include dot data replacing means for replacing values of the dot data for selected at least one of the thermal elements with zero values so as to prevent the selected at least one of thermal elements from being energized by the energizing means.

The dot data replacing means may replace values of every other dot data of the one set of dot data with zero values, to thereby separate, from one another, the dot-shaped perforations actually formed in the heat-sensitive stencil medium, the separate dot-shaped perforations being capable of producing the desired one line image through a stencil printing operation.

The thermal element control means may receive plural sets of dot data which respectively represent desired plural line images and selectively energizes the thermal elements in accordance with the plural sets of dot data in sequence, the thermal element control means selectively preventing the thermal elements from being energized irrespective of the dot data of the plural sets of dot data in the stencil-producing mode. The apparatus may further comprise moving means for attaining, in the stencil-producing mode, relative movement between the thermal elements and the heat-sensitive stencil medium in an auxiliary scanning direction orthogonal to the main scanning direction synchronously with the energize of the thermal elements to thereby form, in the heat-sensitive stencil medium, a plurality of the rows of the dot-shaped perforations which are arranged in the auxiliary scanning direction and which may produce the desired plural line images through a stencil printing operation and for attaining, in the printing mode, relative movement between the thermal elements and the heat-sensitive imaging medium in the auxiliary scanning direction synchronously with the energize of the thermal elements to thereby form, on the heat-sensitive imaging medium, a plurality of the rows of dot-shaped images which are arranged in the auxiliary scanning direction and which correspond to the desired plural line images.

In this case, the thermal element control means includes: input means for receiving the plurality of sets of dot data; energizing means for energizing the thermal elements in accordance with the plurality of sets of dot data in sequence; and second energize control means for preventing all of the thermal elements from being energized irrespective of the dot data of at least one of the plurality of sets of dot data in the stencil-producing mode to thereby form at least one row of dot-shaped perforations where no dot-shaped perforations are actually formed in the heat-sensitive stencil medium.

The second energize preventing means may include dot data set replacing means for replacing values of all the dot data of the at least one of the plurality of sets of dot data with zero values so as to prevent all of the thermal elements from being energized.

The second energize preventing means may prevent all of the thermal elements from being energized irrespective of the dot data of every other set of the plurality of sets of dot data in the stencil-producing mode, to thereby prevent at least two rows of dot-shaped perforations where dot-shaped perforations are actually formed from being arranged adjacent to each other in the auxiliary scanning direction.

The moving means may transport the heat-sensitive stencil medium by a first line distance so that the formed plural rows of dot-shaped perforations may be arranged in the auxiliary scanning direction by the first line distance and transports the heat-sensitive imaging medium by a second line distance so that the formed plural rows of dot-shaped images may be arranged in the auxiliary scanning direction by the second line distance, the first line distance being equal to the second line distance, and wherein the second energize preventing means prevents all of the thermal elements from being energized irrespective of the dot data of ,every other set of the plurality of sets of dot data in the stencil-producing mode, to thereby alternately arrange in the auxiliary scanning direction the rows of dot-shaped perforations where no dot-shaped perforations are actually formed irrespective of the corresponding set of dot data and the rows of dot-perforations where dot-shaped perforations can be actually formed in accordance with the corresponding set of dot data, an actual line distance defined between each two adjacent rows of dot-shaped perforations formed in accordance with the corresponding set of dot data having a value twice a value of the second line distance.

The second energize preventing means may include dot data set replacing means for replacing values of all the dot data of every other one of the plurality of sets of dot data with zero values so as to prevent all of the thermal elements from being energized irrespective of the dot data of the every other set of dot data.

The apparatus may further comprise transport distance changing means for controlling the moving means to transport the heat-sensitive stencil medium by a first line distance so that the formed plural rows of dot-shaped perforations may be arranged in the auxiliary scanning direction by the first line distance and for controlling the moving means to transport the heat-sensitive imaging medium by a second line distance so that the formed plural rows of dot-shaped images may be arranged in the auxiliary scanning direction by the second line distance, the first line distance being longer than the second line distance.

According to another aspect, the present invention provides a stencil-producing apparatus capable of producing a desired stencil from heat-sensitive stencil medium in a stencil-producing mode and capable of thermally printing a desired image on heat-sensitive imaging medium in a printing mode, the stencil-producing apparatus comprising: a thermal head having a plurality of thermal elements aligned in a main scanning direction, the thermal head receiving a plurality of dot data and selectively energizing the thermal elements in accordance with the respective dot data, the selectively energized thermal elements selectively heating a heat-sensitive stencil medium, in a stencil-producing mode, to form therein a row of dot-shaped perforations extending in the main scanning direction and selectively heating a heat-sensitive imaging medium, in a printing mode, to form thereon a row of dot-shaped images extending in the main scanning direction; first energize control means for selectively preventing the thermal elements from being energized irrespective of the dot data in the stencil-producing mode to thereby selectively prevent dot-shaped perforations from being formed in the row of dot-shaped perforations in the heat-sensitive stencil medium; transporting means for attaining, in the stencil-producing mode, relative movement between the thermal head and the heat-sensitive stencil medium in an auxiliary scanning direction orthogonal to the main scanning direction to thereby form, in the heat-sensitive stencil medium, a plurality of the rows of dot-shaped perforations which are arranged in the auxiliary scanning direction and for attaining, in the printing mode, relative movement between the thermal head and the heat-sensitive imaging medium in the auxiliary scanning direction to thereby form, on the heat-sensitive imaging medium, a plurality of the rows of dot-shaped images which are arranged in the auxiliary scanning direction; and pitch adjusting means for controlling at least one of the thermal head and the transporting means to thereby adjust a first pitch by which the rows of dot-shaped perforations are formed to be arranged in the auxiliary scanning direction in the heat-sensitive stencil medium to have a value longer than a second pitch by which the rows of dot-shaped images are arranged in the auxiliary scanning direction in the heat-sensitive imaging medium.

BRIEF DESCRIPTION OF THE DRAWINGS

The above and other objects, features and advantages of the invention will become more apparent from reading the following description of the preferred embodiment taken in connection with the accompanying drawings in which:

FIG. 4 (*b*) is a view schematically showing a continuous perforation formed in heat-sensitive stencil paper using the thermal head shown in FIG. 4 (*a*) for producing a solid pattern;

FIG. 5 (*b*) is a view showing a perforation pattern formed in heat-sensitive stencil paper using the thermal head of FIG. 5 (*a*) for producing a solid pattern stencil;

FIG. 6 (*b*) is a view showing a solid pattern thermally printed on heat-sensitive paper using the thermal head shown in FIG. 6 (*a*);

FIG. 6 (*c*) is a view showing a perforation pattern formed in heat-sensitive stencil paper using the thermal head in FIG. 6 (*a*) for producing a solid pattern stencil;

DETAILED DESCRIPTION OF THE PREFERRED EMBODIMENT

A stencil-producing apparatus according to a preferred embodiment of the present invention will be described while referring to the accompanying drawings. The basic structure of the stencil-producing apparatus 1 of the present invention is substantially the same as that of the conventional apparatus 100 shown in FIG. 1.

Figure 1:
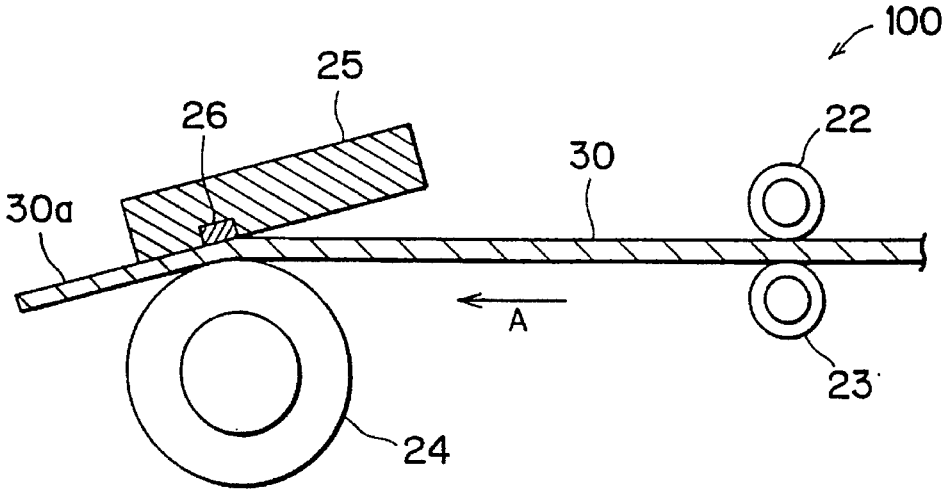
FIG. 1 PRIOR ART
FIG. 1 is a sectional side view schematically showing a conventional stencil-producing apparatus.
Figure 2:
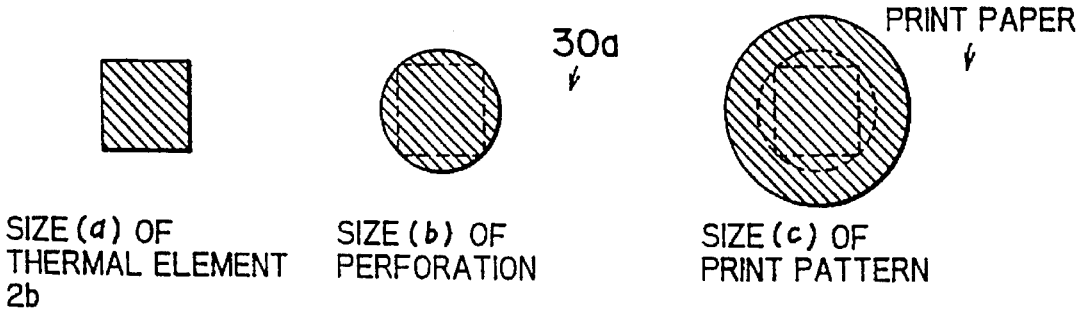
FIG. 2 PRIOR ART
FIG. 2 is a view schematically showing a size (a) of a thermal element, a size (b) of a perforation formed in heat-sensitive stencil paper by the thermal element, and a size (c) of a dot formed by ink permeating through the perforation during stencil printing.
Figure 3:
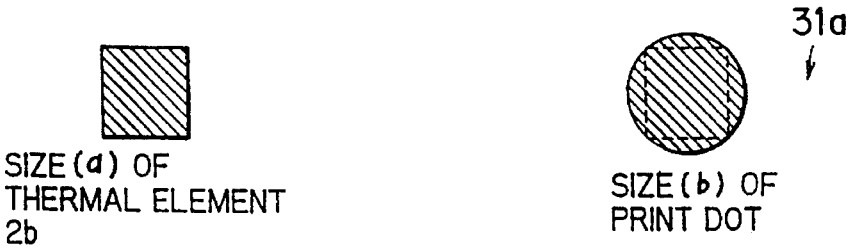
FIG. 3 PRIOR ART
FIG. 3 is a view schematically showing a size (a) of a thermal element and a size (b) of a dot thermally printed on heat-sensitive paper by the thermal element.
Figure 4A:
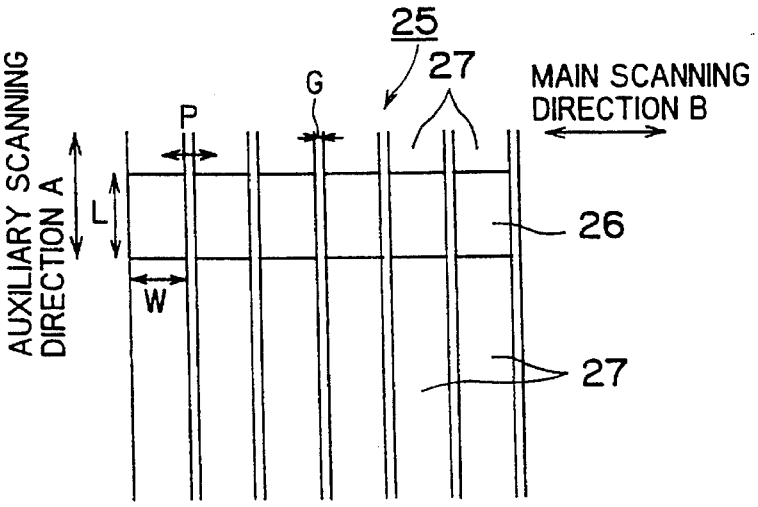
FIG. 4(a) PRIOR ART
FIG. 4 (*a*) is a planar view schematically showing a thermal head used in a conventional facsimile machine.
Figure 4B:
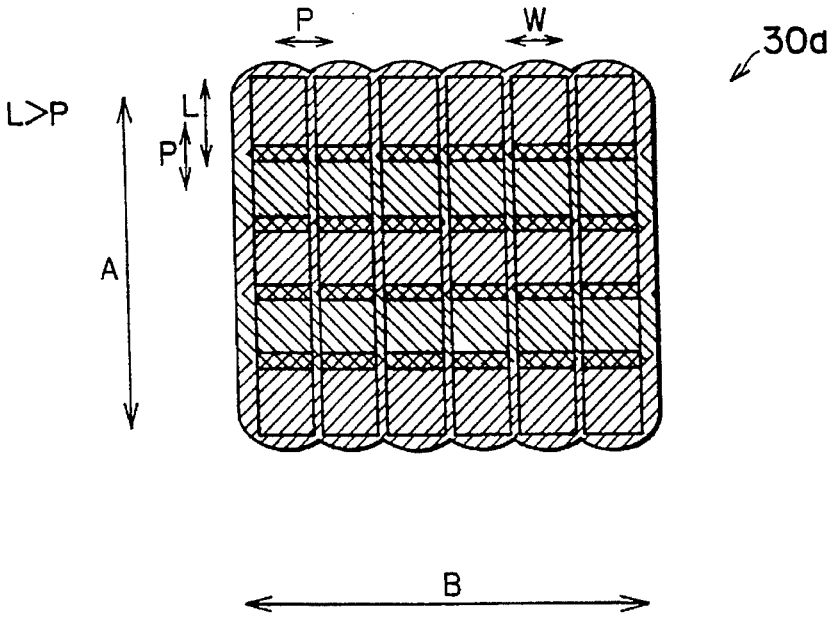
FIG. 4(b) PRIOR ART
Figure 5A:
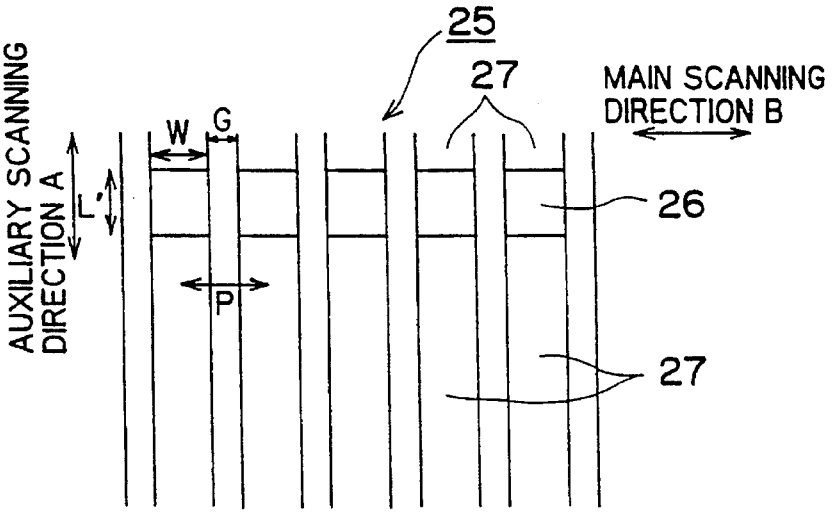
FIG. 5(a) PRIOR ART
FIG. 5 (*a*) is a planar view schematically showing a thermal head used in a conventional stencil-producing apparatus.
Figure 5B:
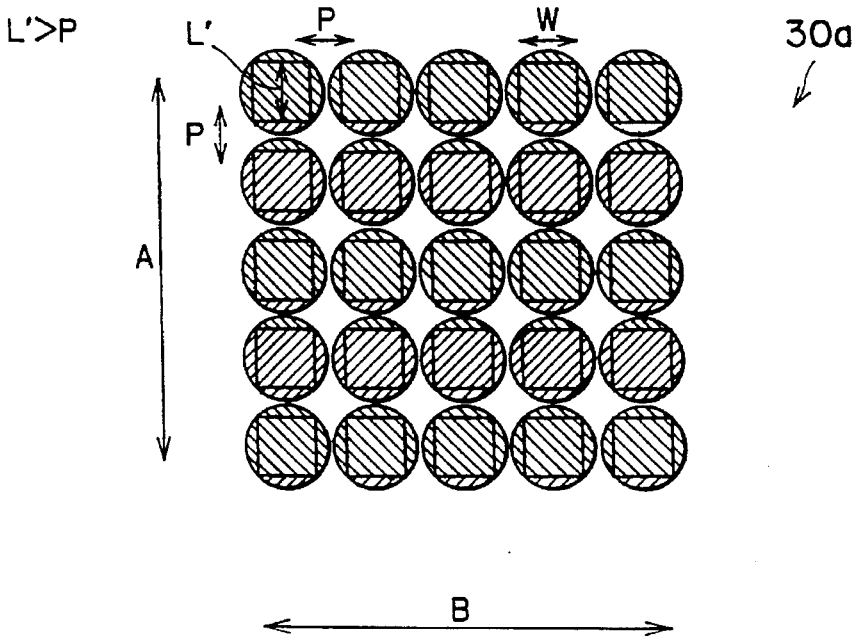
FIG. 5(b) PRIOR ART
Figure 6A:
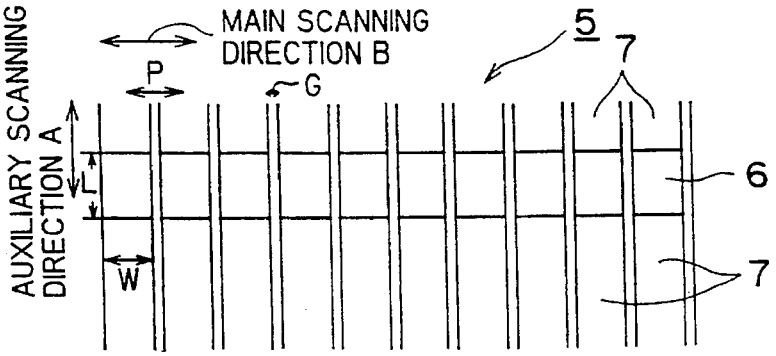
FIG. 6 (*a*) is a planar view schematically showing a thermal head used in a stencil-producing apparatus according to a preferred embodiment of the present invention.
Figure 6B:
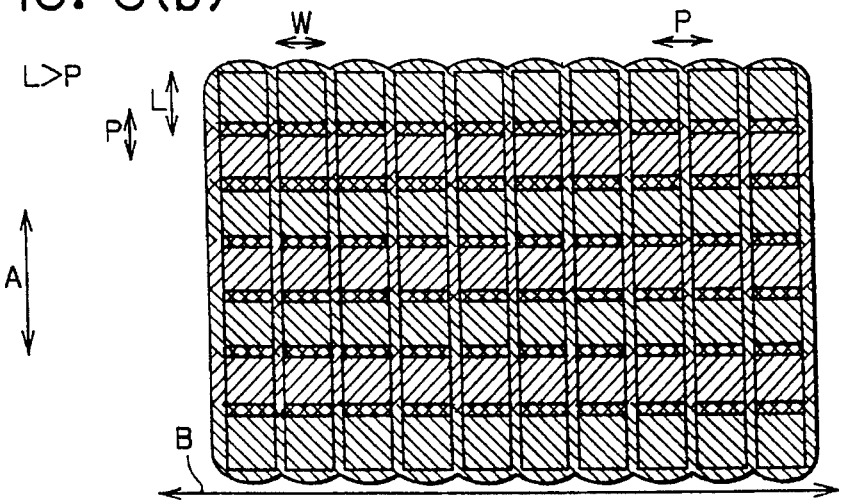
Figure 6C:
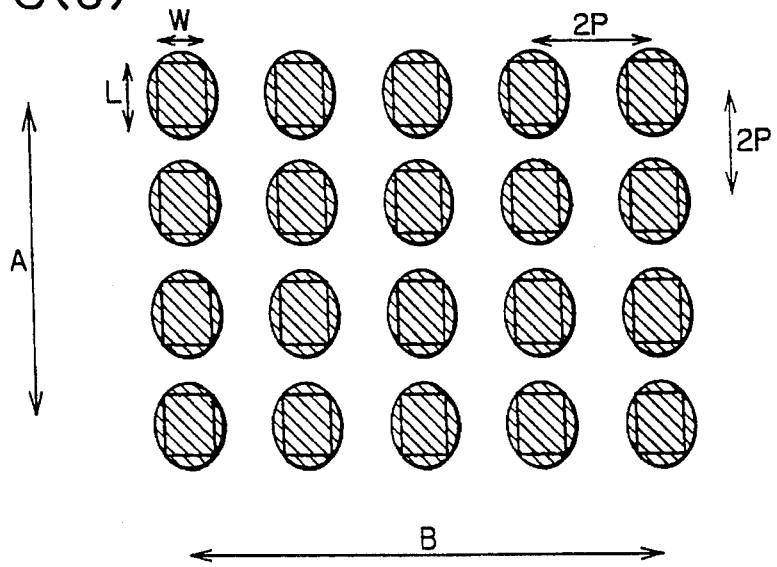

As shown in FIG. 6 (*a*), a thermal head 5 used in the stencil-producing apparatus 1 according to the present invention includes a plurality of thermal elements 6 arranged in a linear array in the main scanning direction B (which is orthogonal to the auxiliary scanning direction A of FIG. 1). Each of the thermal elements 6 has a rectangular shape having a width W in the main scanning direction and having a length L in the auxiliary scanning direction A. The length L has a value almost twice the value of the width W. The thermal elements 6 are arranged in the main scanning direction with a pitch P. The pitch P is slightly larger than the width W of the thermal element 6. A small amount of gap G is therefore formed between adjacent thermal elements 6. A pair of electrodes 7 are connected to both sides of each thermal element 6 in the auxiliary scanning direction for supplying power to the thermal element 6. The transport rollers 22 and 23 are so designed as to feed a heat-sensitive paper 31 in the auxiliary scanning direction B by a line distance almost equal to the pitch P. The line distance P is therefore smaller than the length L of the thermal element 6. To summarize, the relationship among the size (L, W) and pitch (P) of the thermal elements 6 and the paper feeding pitch (P) of the transport rollers 22 and 23 are selected substantially the same as that of the conventional stencil-producing apparatus 100 of FIG. 1 employed with the thermal , head 25 of FIG. 4 (*a*). Accordingly, the apparatus 1 of the present invention can inherently print a good solid pattern on heat-sensitive paper 31 with no spaces between adjacent dots, similarly to the apparatus 100 as described already with reference to FIG. 4 (*b*).

It is noted, however, that contrary to the conventional apparatus 100, according to the present invention, the above-described size and pitch of the thermal elements 6 and paper feeding pitch are so selected as to provide a potential resolution two times a resolution desired to be obtained by the stencil-producing apparatus 1 of the present invention, as will be described later in greater detail. For example, if the resolution desired to be obtained by the apparatus is set at 200 dots/inch (dpi), the thermal head 5 should be so designed as to have the width W of 47 μm, the length L of 80 μm, and the pitch P of 63.5 μm which define a potential resolution of 400 dpi.

Figure 7:
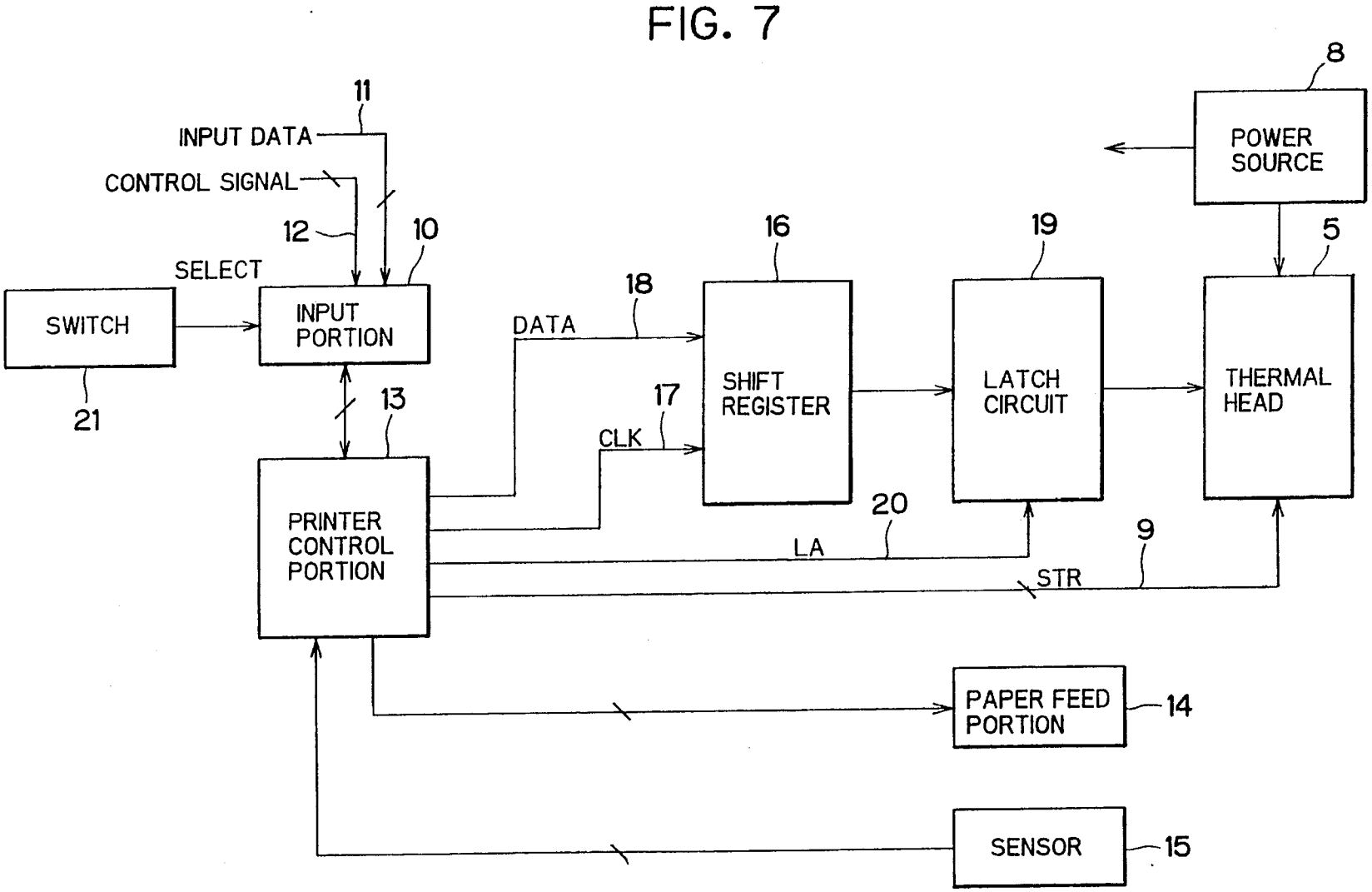
FIG. 7 is a block diagram showing a control circuit for controlling the stencil-producing apparatus of the present invention employed with the thermal head shown in FIG. 6 (*a*)

As shown in FIG. 7, the stencil-producing apparatus 1 of the present invention is provided with an input portion 10 for controlling input of data from an external apparatus (not shown) into the stencil-producing apparatus 1. More specifically, the input portion 10 is supplied with a plurality of sets of input data 11 such as character data or image data. The plural sets of input data 11 respectively represent plural image lines desired to be obtained on the heat-sensitive paper 31 to be arranged in the auxiliary scanning direction A, each of the image lines extending in the main scanning direction B. The input portion 10 receives the input data 11, according to an RS-232C interface reference signal applied thereto. The input portion 10 is further supplied with a control signal 12 for controlling input of the input data 11 thereto from the external apparatus. The printer control portion 13 controls the entire part of the apparatus 1 based on the input data 11 inputted to the input portion 10. The printer control portion 13 outputs a sheet feed command to a paper feed portion 14, based on the input data 11. The paper feed portion 14 drives a sheet feed motor (not shown) accordingly to thereby rotate the transport rollers 22 and 23. A sensor unit 15 is provided for detecting operation state of the apparatus 1. The sensor unit 15 includes a plurality of detectors which, for example, detect presence, or absence, of print paper or stencil paper, or temperature of the thermal head 5. The sensor unit 15 outputs detection signals indicative of the detected results to the printer control portion 13. The printer control portion 13 controls the entire apparatus 1 also based on the detection signals.

The printer control portion 13 develops one set of input data 11 for one line image to produce one set of dot data (DATA) 18 for driving the thermal head 5 to form the corresponding one line image. The printer control portion 13 outputs transmit clock signals CLK 17. Synchronously with the transmit clock signals 17, the printer control portion 13 outputs one set of dot data 18 in serial form. A shift resistor 16 is connected to the printer control portion 13 for receiving and storing the transmit clock (CLK) signal 17 and the dot data (DATA) 18. The printer control portion 13 outputs a latch signal (LA) 20 at the same time when it completely outputs the one set of dot data 18 of one line image. A latch circuit 19 is connected to the shift register 16 and the printer control portion 13. The latch circuit 19 receives, in parallel, the one set of dot data 18 from the shift register 16 when it receives the latch signal (LA) 20 from the printer control portion 13. The latch circuit 19 then latches the one set of dot data in accordance with the received latch signal 20 until when the thermal head 5 receives a strobe signal (STR) 9 of an active (ON) state. The printer control portion 13 outputs the strobe signal 9 to the thermal head 5. The strobe signal 9 in an active (ON) state allows the thermal head 5 to be selectively connected to a power source 8. The set of dot data 18 latched in the latch circuit 19 represent information on whether or not each thermal element 6 of the thermal head 5 should be supplied with electric current from the power source 8 to be energized or heated. Accordingly, during the strobe signal 9 is in the active (ON) state, the latch circuit 19 controls the thermal elements 6 to be selectively connected to a power source 8, in accordance with the set of dot data 18. Thus energizing the thermal head 5 selectively opens perforations in the thermoplastic film 30*a* of the heat-sensitive stencil paper 30 or selectively forms colors in the heat-sensitive layer 31*a* of the heat-sensitive paper 31. Thus, one line image is produced in the heat-sensitive stencil paper 30 or the heat-sensitive paper 31, in accordance with the set of dot data 18. Since the thermal elements 6 are arranged in the main scanning direction B, the produced one line image extends also in the main scanning direction. When the printer control portion 13 turns the strobe signal 9 to a non-active (OFF) state, the perforating operation or the printing operation is stopped. Simultaneously, the printer control portion 13 outputs the sheet feed command to the paper feed portion 14. The paper feed portion 14 accordingly starts rotating the transport rollers 22 and 23 so that the paper 30 or 31 may be transported in the auxiliary scanning direction A by a line distance equal to the pitch P of the thermal elements 6.

It is noted that after when the one set of dot data 18 for one line image are transferred to the latch circuit 19, the printer control portion 13 begins transferring another set of dot data 18 for the next line image in serial form to the shift register. 16 at appropriate timings determined by the transmit clock signals CLK.

A switch 21 for selecting a stencil-producing operation or a printing operation is provided at a predetermined position on a housing of the stencil-producing apparatus 1 (not shown). An operator can operate the switch 21 to select one of the stencil-producing operation and the printing operation. The switch 21 produces a selection signal SELECT representing that the operator has selected the stencil-producing operation or printing operation. The switch 21 is connected to the printer control portion 13 for supplying the portion 13 with the selection signal SELECT. The printer control portion 13 performs control, operation shown in FIG. 8 based on the selection signal SELECT.

Figure 8:
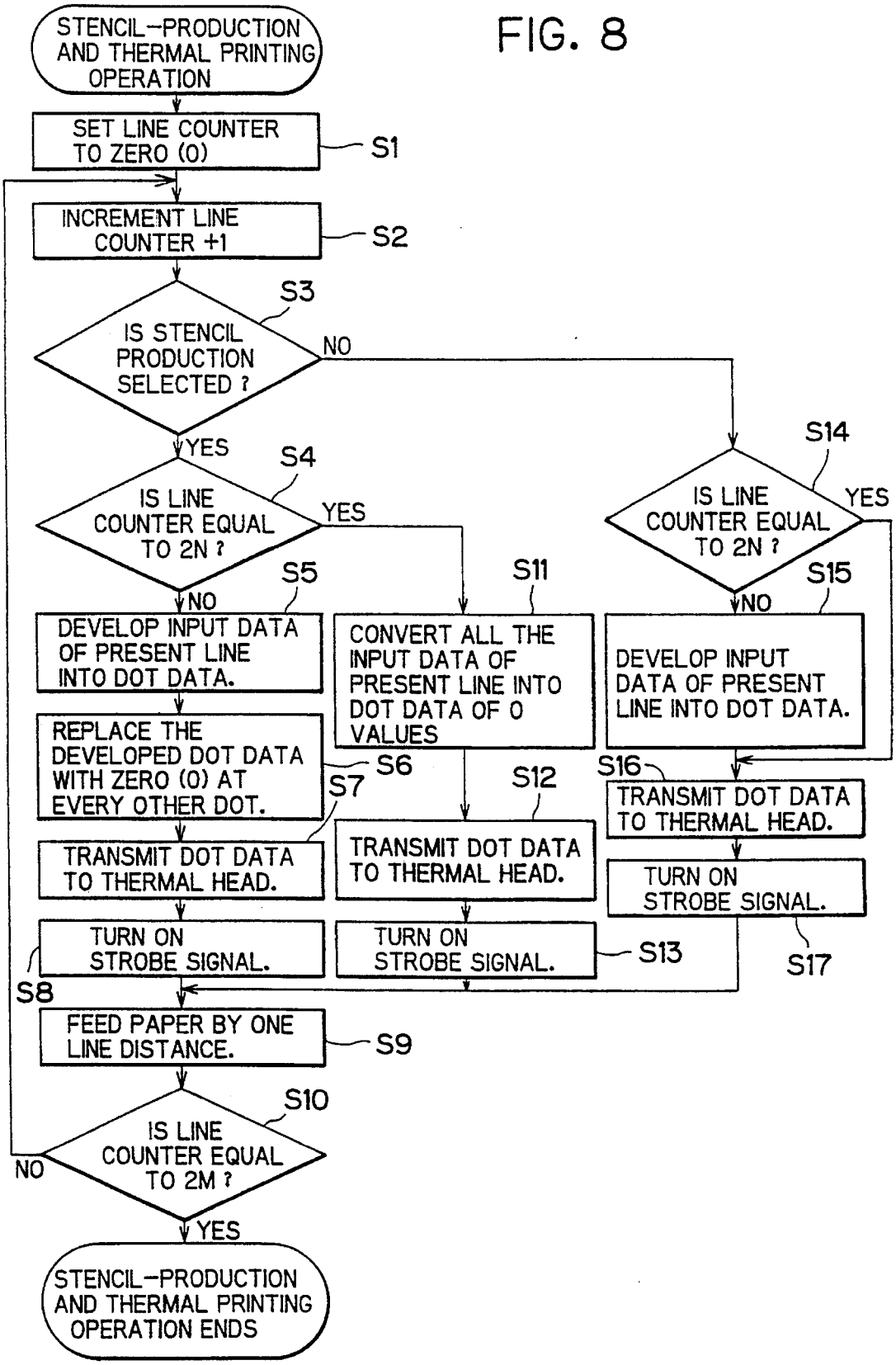
FIG. 8 is a flowchart showing a print operation on heat-sensitive paper and stencil production operation on heat-sensitive stencil paper according to the present invention.

FIG. 8 shows the control operations involved in producing a stencil in heat-sensitive stencil paper 30 and thermally producing images or characters in heat-sensitive paper 31. The control operations other than those illustrated in FIG. 8 are the same as in conventional stencil-producing apparatuses and thermal printers, and so will be omitted from this explanation.

In this explanation, for clarity and simplicity, assume that the already-described thermal head 5 sized and arranged for the potential resolution of 400 dpi is employed for producing an image of the desired resolution of 200 dpi. Further assume that the thermal head 5 is constructed by forty eight (48) thermal elements 6 (which will be referred to as "thermal elements T1, T2, T3, . . . , and T48," hereinafter) arranged in the main scanning direction B. In this case, one set of input data 11 inputted to the input portion 10 bears thereon information on one line image formed from forty eight dots. Accordingly, the printer control portion 13 develops one set of input data 11 for one line image into one set of dot data 18 formed from forty eight (48) dot data (which will be referred to as "D1, D2, D3, . . . , and D48," hereinafter). Each of the forty eight dot data represents whether or not the corresponding one of the forty eight thermal elements 6 should be energized. More specifically, the dot data D1, D2, D3, . . . and D48 represent whether or not the thermal elements T1, T2, T3, . . . , and T48 should be energized. The forty eight thermal elements 6 will therefore produce one line image extending in the main scanning direction B. This one line image is formed from forty eight dots at the potential resolution of 400 dpi.

Now, further assume that the desired image to be obtained has twenty four (24) lines at the desired resolution of 200 dpi in the auxiliary scanning direction A. The twenty four lines at the desired resolution of 200 dpi corresponds to forty eight (48) lines at the potential resolution of 400 dpi. Accordingly, in this case, forty eight sets of input data 11 are inputted to the input portion 10. The forty eight sets of input data 11 bear information on the forty eight image lines, respectively, at the 400 dpi potential resolution. To summarize, in this example, the input portion 10 is supplied with input data 11 which bears information on an image having 48×48 dots at the potential resolution of 400 dpi. Based on the input data 11, a desired image which has 24×24 dots at the desired resolution of 200 dpi is obtained, where each dot unit at the 200 dpi resolution is constructed by 2×2 dots at the 400 dpi.

As shown in FIG. 8, when the stencil-producing apparatus 1 is energized, a value set in a line counter (not shown) provided in the printer control portion 13 is first initialized to a value of zero, in step S1. The line counter is for determining what the present line corresponds to in the auxiliary scanning direction A at the potential resolution of 400 dpi. In step S2, the value in the line counter is incremented by one (1). In step S3, the operator inserts a heat-sensitive stencil paper 30 or a heat-sensitive paper 31 between the transport rollers 22 and 23 of the apparatus 1, and operates the switch 21 to select either one of the stencil-producing operation and the printing operation. The printer control portion 13 judges, based on the selection signal SELECT, whether the apparatus is desired to perform the stencil production or the printing operation. If stencil production operation is selected (YES in the step S3), the printer control portion 13 judges in step S4 whether or not the line counter value at this point is an even number, i.e., the value of 2N (where N is an arbitrary integral number). If the value in the line counter is an odd number (No in step S4), the printer control portion 13 develops one set of input data 11 for the present line into one set of dot data 18, in step S5. The one set of dot data includes forty eight dot data in this example. In step S6, dot data that is even numbered as based on the order that the dot data are serially transmitted to the shift resistor 16 is replaced with a value of zero (0) More specifically, if the printer control portion 13 serially outputs the forty eight dot data D1, D2, D3, . . . and D48 in this order to the shift register 16, the dot data D2, D4, D6, . . . , and D48 are replaced with values of zero. When the dot data for a particular dot has a value of zero, the corresponding thermal element will not be energized so that no perforation dot will be formed. Accordingly, the thermal elements T2, T4, T6, . . . and T48 will not be energized. In other words, thermal drive of the thermal elements 6 is selectively precluded for every other thermal element.

Next, the one set of dot data for the present line are transmitted in serial form to the shift register 16. When the set of dot data for the line are completely transmitted to the shift register 16, the shift register 16 transmits in parallel form the set of dot data to the latch circuit 19 in step S7. When the strobe signal 9 is turned ON, the thermal head 5 starts forming the line of perforation dots in step S8 in accordance with the one set of dot data latched in the latch circuit 19. When the line of perforation dots have been formed, the strobe signal 9 is turned OFF. The transport rollers 22 and 23 then start feeding the heat-sensitive stencil paper 30 by the line distance P in the auxiliary direction in step S9. Then, in step S10, the printer control portion 13 judges whether or not the value at the line counter is 2M (total line number of the image desired to be formed on the sheet of heat-sensitive stencil paper at the potential resolution; 2M equals forty eight in this example). If the value of the line counter reaches the value 2M, the stencil producing operation is completed. Until 2M is attained, the program returns to step S2 and processes are repeated.

In step S4, if the line counter value is an even number, that is, Yes in the step S4, the one set of input data 11 for this line are converted into one set of dot data 18 each having a value of zero (0) in step S11. Accordingly, all the dot data D1, D2, D3, . . . , and D48 obtained for this line have zero values. In step S12, the one set of dot data of zero values are transmitted to the shift register 16 and further to the latch circuit 19. The strobe signal 9 is turned ON in step S13 to form the present one line of perforation dots. It is noted, however, that all dot data are now set to zero and therefore no perforations are actually formed in this line. When this even numbered line of perforations are completed, the program proceeds to step S9, and the above-described operations are performed. With this operation, thermal drive of the thermal head 5 is selectively precluded for every other line. Accordingly, an actual pitch by which the actually obtained dot-perforation lines are arranged in the auxiliary scanning direction has a value of 2P which is twice the pitch P by which the feed rollers 22 and 23 feeds the paper 30.

If the operator performs the switch 21 to select the printing operation, i.e., if No in the step S3, the printer control portion 13 judges in step S14 whether or not the value in the line counter is an even number 2N (wherein N is an arbitral integral number). If in step S14 the value at the line counter is odd, one set of input data for the present line are developed into one set of dot data in step S15. The developed set of dot data are transmitted to the shift register 16 and further to the latch circuit 19 in step S16. When the strobe signal 9 is turned ON, the line is thermally printed in step S17. When the present line is thus completely printed, the program proceeds to step S9 whereupon the heat-sensitive paper 31 is fed by one line distance P in the auxiliary scanning direction. In step S10, the printer control portion 13 judges whether or not the value at the line counter is 2M (total number of lines desired to be formed on the sheet of heat-sensitive medium at the potential resolution; forty eight in this example). If the value at the line counter attains 2M, the printing operation is completed. However, until 2M is attained at the line counter, the program returns to step S2, and operations are repeated. In the step S14, if the value at the line counter is even, i.e., if Yes in the step S14, the program skips the step S15, and therefore one set of input data 11 for the present line are not developed. Accordingly, one set of dot data already obtained for the preceding odd numbered line are used as one set of dot data for this present even numbered line. For example, one set of dot data already obtained for the first line are used also as one set of dot data for the second line. In the step S16, then, the set of dot data of the preceding odd number line are transmitted to the shift register 16 and further to the latch circuit 19. Then, the above-described operations are performed. With this operation, contrary to the stencil-producing operation, the thermal drive of the thermal head is not precluded for every other line. Accordingly, the pitch by which the dot-image lines are arranged in the auxiliary scanning direction is equal to the pitch P by which the feed rollers 22 and 23 feeds the paper 31.

Figure 9:
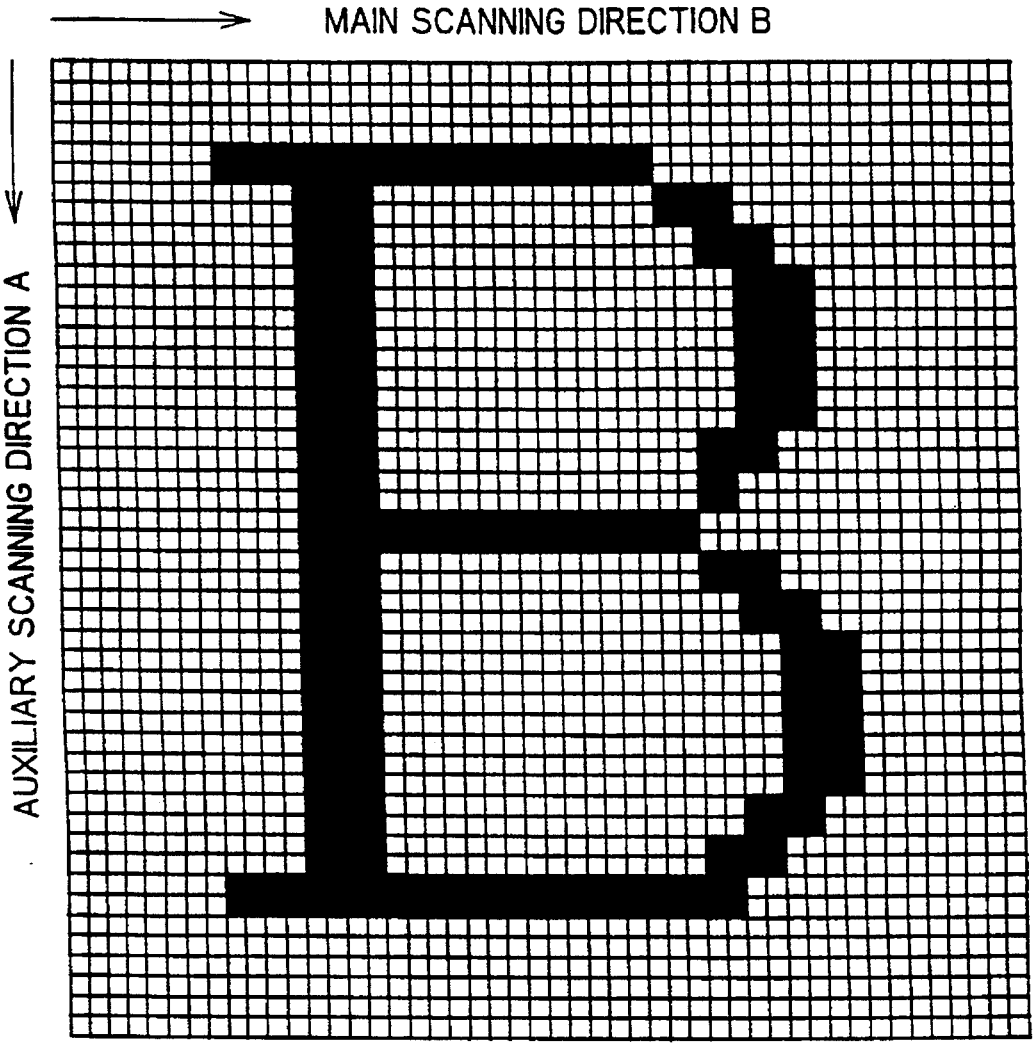
FIG. 9 is a view showing an example of a character thermally printed by a stencil-producing apparatus according to the present invention.

As shown in FIG. 9, a character B thermally printed with the above-described thermal printing operation has no spaces between adjacent thermally printed dots so that a good solid pattern can be obtained. Although the thermal head has the potential dot resolution of 400 dpi over an area of 48×48 dots, the character B is actually formed with the desired 200 dpi resolution over a 24×24 dot area because the smallest dot unit is formed by 2×2 dots.

Figure 10:
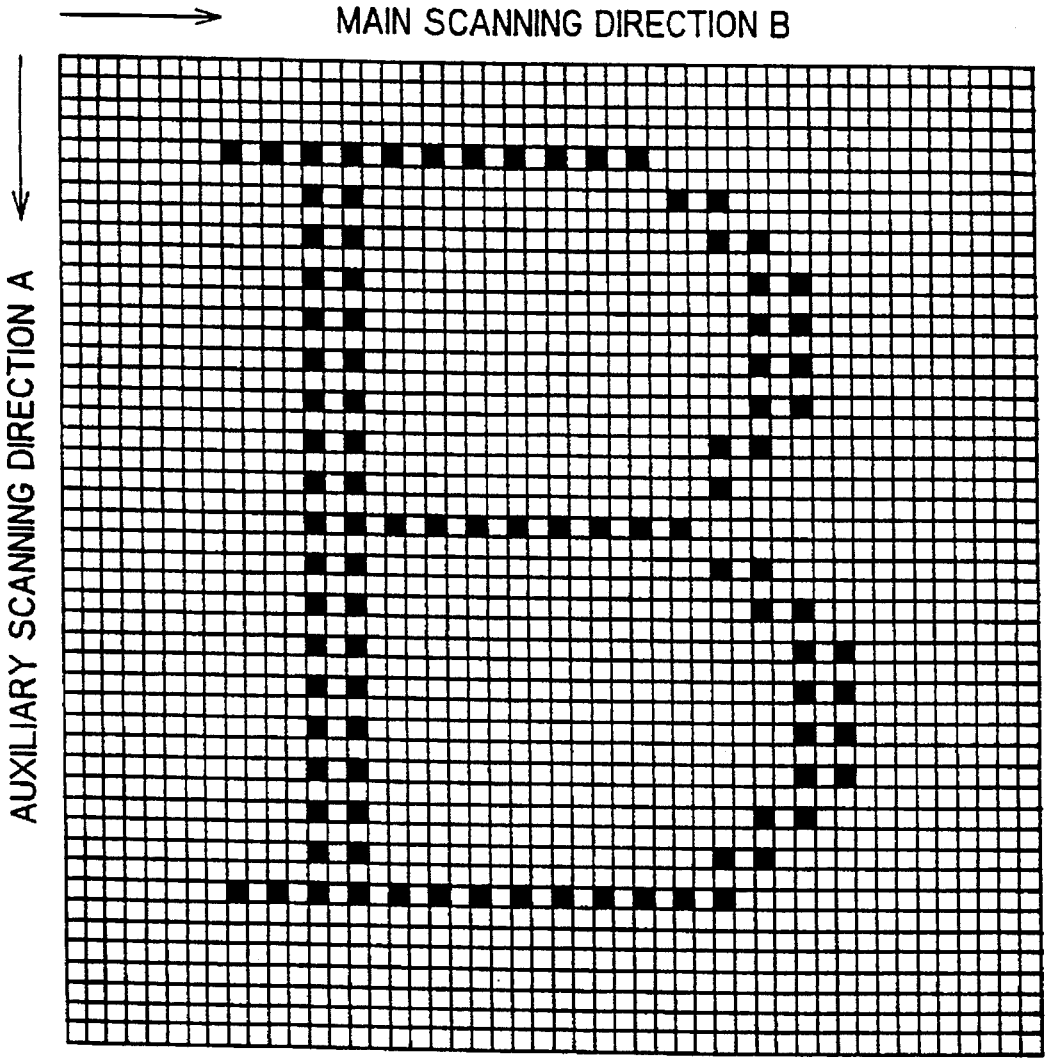
FIG. 10 is a view showing an example of a character stencil produced by a stencil-producing apparatus according to the present invention.

As shown in FIG. 10, a stencil of a character B produced with the stencil producing operation has no connected dot perforations. (The blackened dots represent perforated portions.) All perforations are separate so that a character B as shown in FIG. 9 will be stencil printed well.

To summarize, the stencil-producing apparatus according to the present embodiment is constructed to provide the potential resolution two times the desired resolution. More specifically, the thermal head 6 is sized and arranged to provide the potential resolution two times the desired resolution in the main scanning direction. The transport rollers 22 and 23 are driven to feed the heat-sensitive stencil paper 30 and the heat-sensitive paper 31 by a line distance P which defines the potential resolution two times the desired resolution in the auxiliary scanning direction. When stencil are produced in heat-sensitive stencil paper 30, thermal drive of the thermal elements 6 is selectively precluded for every other dot in the main scanning direction (in the step S6) and for every other line in the auxiliary scanning direction (in the step S11). In other words, thermal drive for every other dot is skipped both in the main scanning direction and in the auxiliary scanning direction. Accordingly, spaces are provided between adjacent dot perforations, and stencil printing can provide good prints without set off and with low blurring. When images or characters are thermally printed on heat-sensitive paper 31, on the other hand, the thermal drive of the thermal elements 6 is not selectively precluded (i.e., no dots are skipped) in the main scanning direction. The same thermal drive of the thermal elements is conducted for every two lines adjacent in the auxiliary scanning direction. In addition, the heat-sensitive paper is fed in the auxiliary scanning direction at a very small feed pitch P of 63.5 μm which is smaller than the length of 80 μm of the thermal element in the auxiliary scanning direction. Accordingly, good printing with no gaps between adjacent dots can be obtained.

Accordingly, when the input data 11 received by the input portion 10 represent a solid pattern, for example, the above-described stencil producing operation can produce a stencil pattern as shown in FIG. 6 (*c*) where spaces are provided between adjacent dot perforation. The stencil pattern will print, through stencil printing operation, a good solid printing pattern without set off and with low blurring. Similarly, when the input data 11 received by the input portion 10 represent the solid pattern, the above-described printing operation can produce a good solid printing pattern as shown in FIG. 6 (*b*) where no spaces are provided between adjacent dot images.

While the invention has been described in detail with reference to a specific embodiment thereof, it would be apparent to those skilled in the art that various changes and modifications may be made therein without departing from the spirit of the invention.

For example, in the above-described embodiment, in the stencil producing operation, thermal drive of the thermal elements 6 is selectively precluded for every other line in the auxiliary scanning direction. Alternatively, the transport rollers 22 and 23 may be rotated, in the stencil producing operation, to feed the heat-sensitive stencil paper by a feed amount or line distance 2P so that the actually obtained dot-perforation lines may be arranged by a line distance 2P in the auxiliary scanning direction.

The above-described embodiment has been constructed so that the potential resolution obtained by the size of thermal head 5 and the feed amount of the feed rollers 22 and 23 are two times the desired resolution set in the stencil-producing apparatus. However, in order to provide an even better printing state during stencil production, the potential resolution can be further increased.

As described above, according to the stencil-producing apparatus of the present invention, both the stencil production and the thermal printing are possible. This is achieved by a thermal head which performs stencil production by forming dot-shaped perforations in a heat-sensitive stencil medium and which prints images by forming dot-shaped images in a heat-sensitive imaging medium by heating a plurality of thermal elements aligned in a main scanning direction. During thermal printing, the pitch of the relative movement between the heat-sensitive medium and the thermal element in the auxiliary direction is set to a minimal. During stencil production, heat drive of the thermal elements is selectively precluded in the main scanning direction. Heat drive of the thermal elements is selectively precluded also in the auxiliary scanning direction. Or otherwise, the pitch of the relative movement between the thermal head and the heat-sensitive stencil medium in the auxiliary scanning direction may be increased to a pitch longer than the pitch during printing. This provides spaces between adjacent dots of the resultant stencil. Stencil printing with no blurring and no set off can be achieved with such a stencil. Also, good thermal printing on heat-sensitive imaging medium with no spaces between adjacent dots can be achieved.

What is claimed is:

1. An apparatus capable of producing a desired stencil from heat-sensitive stencil medium in a stencil-producing mode and capable of thermally printing a desired image on heat-sensitive imaging medium in a printing mode, the apparatus comprising:

a plurality of thermal elements aligned in a main scanning direction;

thermal element control means for receiving one set of dot data including a plurality of dot data representative of a desired one line image and for selectively energizing thermal elements according to the plurality of dot data, said thermal element control means selectively preventing said plurality of thermal elements from being energized irrespective of the plurality of dot data in the stencil-producing mode; and supporting means for supporting a heat-sensitive stencil medium in direct contact with said plurality of thermal elements in the stencil-producing mode allowing the selectively energized thermal elements to selectively heat the heat-sensitive stencil medium to form therein a row of dot-shaped perforations extending in the main scanning direction to produce the desired one line image corresponding to the selectively energized thermal elements in the stencil-producing mode and for supporting a heat-sensitive imaging medium in direct contact with said plurality of thermal elements in the printing mode allowing the selectively energized thermal elements to selectively heat the heat-sensitive imaging medium to form thereon a row of dot-shaped images extending in the main scanning direction that correspond to the desired one line image.

2. An apparatus as claimed in claim 1, wherein said thermal element control means includes:

input means for receiving the one set of dot data including the plurality of dot data for said plurality of thermal elements;

energizing means for energizing said thermal elements according to the plurality of dot data; and first energize preventing means for selectively preventing said plurality of thermal elements from being energized by said energizing means irrespective of the dot data in the stencil-producing mode to thereby selectively prevent dot-shaped perforations from being formed in the row of dot-shaped perforations in the heat-sensitive stencil medium.

3. An apparatus as claimed in claim 2, wherein said first energize preventing means selectively prevents energizing said plurality of thermal elements for every other thermal element, to thereby separate, from one another, the dot-shaped perforations formed in the heat-sensitive stencil medium, the separate dot-shaped perforations capable of producing the desired one line image corresponding to the selectively energized thermal elements in a stencil-producing mode.

4. An apparatus as claimed in claim 2, wherein said first energize preventing means includes dot data replacing means for replacing values of the plurality of dot data for selected at least one of said plurality of thermal elements with zero values to prevent said selected at least one of said plurality of thermal elements from being energized by said energizing means.

5. An apparatus as claimed in claim 4, wherein said dot data replacing means replaces values of every other dot data of the one set of dot data with zero values, to thereby separate, from one another, the dot-shaped perforations formed in the heat-sensitive stencil medium, the separate dot-shaped perforations being capable of producing the desired one line image corresponding to the selectively energized thermal elements in a stencil-producing mode.

6. An apparatus as claimed in claim 1, wherein said supporting means includes a platen roller for pressing the heat-sensitive stencil medium to said plurality of thermal elements in the stencil-producing mode and for pressing the heat-sensitive imaging medium to said plurality of thermal elements in the printing mode.

7. An apparatus as claimed in claim 1, wherein said thermal element control means receives plural sets of dot data that respectively represent desired plural line images and selectively energizes said plurality of thermal elements according to the plural sets of dot data in sequence, said thermal element control means selectively preventing said plurality of thermal elements from being energized irrespective of the dot data of the plural sets of dot data in the stencil-producing mode; and further comprising moving means for attaining, in the stencil-producing mode, relative movement between said plurality of thermal elements and the heat-sensitive stencil medium in an auxiliary scanning direction orthogonal to the main scanning direction synchronously with the energization of said plurality of thermal elements to thereby form, in the heat-sensitive stencil medium, a plurality of the rows of the dot-shaped perforations that are arranged in the auxiliary scanning direction and producing the desired plural line images in a stencil-producing mode and for attaining, in the printing mode, relative movement between said plurality of thermal elements and the heat-sensitive imaging medium in the auxiliary scanning direction synchronously with the energization of said plurality of thermal elements to thereby form, on the heat-sensitive imaging medium, a plurality of the rows of dot-shaped images that are arranged in the auxiliary scanning direction and correspond to the desired plural line images.

8. An apparatus as claimed in claim 7, wherein said thermal element control means includes:

input means for receiving the plurality of sets of dot data;

energizing means for energizing said plurality of thermal elements according to the plurality of sets of dot data in sequence; and second energize control means for preventing said plurality of thermal elements from being energized irrespective of dot data of at least one of the plurality of sets of dot data in the stencil-producing mode to thereby form at least one row of dot-shaped perforations at a location where no dot-shaped perforations are formed in the heat-sensitive stencil medium.

9. An apparatus as claimed in claim 8, wherein said second energize preventing means includes dot data set replacing means for replacing values of the dot data of the at least one of the plurality of sets of dot data with zero values to prevent said plurality of thermal elements from being energized.

10. An apparatus as claimed in claim 8, wherein said second energize preventing means prevents said plurality of thermal elements from being energized irrespective of the dot data of every other set of the plurality of sets of dot data in the stencil-producing modem to thereby prevent at least two rows of dot-shaped perforations where dot-shaped perforations are formed from being arranged adjacent to each other in the auxiliary scanning direction.

11. An apparatus as claimed in claim 10, wherein said moving means transports the heat-sensitive stencil medium by a first line distance so that formed plural rows of dot-shaped perforations are arranged in the auxiliary scanning direction by the first line distance and transports the heat-sensitive imaging medium by a second line distance so that formed plural rows of dot-shaped images are arranged in the auxiliary scanning direction by the second line distance, the first line distance being equal to the second line distance, and wherein said second energize preventing means prevents said plurality of thermal elements from being energized irrespective of dot data of every other set of the plurality of sets of dot data in the stencil-producing mode, to thereby alternately arrange in the auxiliary scanning direction the rows of dot-shaped perforations at a location where no dot-shaped perforations are formed according to the corresponding set of dot data, an actual line distance defined between each two adjacent rows of dot-shaped perforations formed according to the corresponding set of dot data having a value twice a value of the second line distance.

12. An apparatus as claimed in claim 11, wherein said second energize preventing means includes dot data set replacing means for replacing values of dot data of every other one of the plurality of sets of dot data with zero values to prevent said plurality of thermal elements from being energized irrespective of the dot data of the every other one of the plurality of sets of dot data.

13. An apparatus as claimed in claim 7, further comprising transport distance changing means for controlling said moving means to transport the heat-sensitive stencil medium by a first line distance so that the formed plural rows of dot-shaped perforations are arranged in the auxiliary scanning direction by the first line distance and for controlling said moving means to transport the heat-sensitive imaging medium by a second line distance so that the formed plural rows of dot-shaped images are arranged in the auxiliary scanning direction by the second line distance, the first line distance being longer than the second line distance.

14. A stencil-producing apparatus capable of producing a desired stencil from heat-sensitive stencil medium in a stencil-producing mode and capable of thermally printing a desired image on heat-sensitive imaging medium in a printing mode, the stencil-producing apparatus comprising:

a thermal head having a plurality of thermal elements aligned in a main scanning direction, said thermal head receiving a plurality of dot data and selectively energizing thermal elements according to the plurality of dot data, the selectively energized thermal elements selectively heating a heat-sensitive stencil medium, in a stencil-producing mode, to form therein a row of dot-shaped perforations extending in the main scanning direction and selectively heating a heat-sensitive imaging medium, in a printing mode, to form thereon a row of dot-shaped images extending in the main scanning direction;

first energize control means for selectively preventing said plurality of thermal elements from being energized irrespective of the plurality of dot data in the stencil-producing mode to thereby selectively prevent dot-shaped perforations from being formed in the row of dot-shaped perforations in the heat-sensitive stencil medium;

transporting means for attaining, in the stencil-producing mode, relative movement between the thermal head and the heat-sensitive stencil medium in an auxiliary scanning direction orthogonal to the main scanning direction to thereby form, in the heat-sensitive medium, a plurality of the rows of dot-shaped perforations that are arranged in the auxiliary scanning direction and for attaining, in the printing mode, relative movement between the thermal head and the heat-sensitive imaging medium in the auxiliary scanning direction to thereby form, on the heat-sensitive imaging medium, a plurality of the rows of dot-shaped images that are arranged in the auxiliary scanning direction; and pitch adjusting means for controlling at least one of said thermal head and said transporting means to thereby adjust a first pitch by which the rows of dot-shaped perforations are formed in the auxiliary scanning direction in the heat-sensitive stencil medium to have a value longer than a second pitch by which the rows of dot-shaped images are arranged in the auxiliary scanning direction in the heat-sensitive medium.

15. A stencil-producing apparatus as claimed in claim 14, wherein said first energize control means selectively prevents energizing of said plurality of thermal elements for every other thermal element, to thereby separate, from one another, the dot-shaped perforations formed to be arranged in the row of dot-shaped perforations in the heat-sensitive stencil medium.

16. A stencil-producing apparatus as claimed in claim 14, wherein said pitch adjusting means includes second energize control means for preventing said plurality of thermal elements of said thermal head from being energized irrespective of the dot data in the stencil-producing mode to thereby form one row at a location where no dot-shaped perforations are formed in the main scanning direction, said second energize control means forming the one row formed with no dot-shaped perforations between each two adjacent rows of dot-shaped perforations arranged in the auxiliary scanning direction so that the first pitch defined by the each two adjacent rows of dot-shaped perforations has a value twice a value of the second pitch.

17. A stencil-producing apparatus as claimed in claim 14, wherein said pitch adjusting means includes transport distance changing means for controlling said transporting means to transport the heat-sensitive stencil medium by a first distance and for controlling said transporting means to transport the heat-sensitive imaging medium by a second distance, the first distance being longer than the second distance.

* * * * *